US005880385A

United States Patent [19]

Goldin et al.

[11] Patent Number: 5,880,385

[45] Date of Patent: Mar. 9, 1999

[54] PEG DEVICE FOR USE IN TENSIONING DRUM SKINS AND TO NOVEL SHAPED DRUMS USING THE PEG DEVICE

[75] Inventors: Darren Brett Goldin, Fletcher Falls; Jim Stewart Smith, Kaslo, both of Canada

[73] Assignee: Darren B. Goldin, Fletcher Falls, Canada

[21] Appl. No.: 834,138

[22] Filed: Apr. 14, 1997

[30] Foreign Application Priority Data

Jan. 14, 1997 [CA] Canada ..... 2195054

[51] Int. Cl.[6] ..... G10D 13/02

[52] U.S. Cl. ..... 84/413

[58] Field of Search ..... 84/413

[56] References Cited

U.S. PATENT DOCUMENTS

| | | | |
|---|---|---|---|
| 37,570 | 2/1863 | Dermond | 84/413 |
| 355,057 | 12/1886 | Buchanan | 84/413 |
| 1,094,029 | 4/1914 | Soistmann | 84/413 |
| 1,165,666 | 12/1915 | Gurney | 84/413 |
| 3,185,013 | 5/1965 | Gussak | 84/413 |
| 4,709,613 | 12/1987 | Powers et al. | 84/413 |

*Primary Examiner*—William M. Shoop, Jr.
*Assistant Examiner*—Jeffrey W. Donels
*Attorney, Agent, or Firm*—Charles P. Boukus, Jr.

[57] ABSTRACT

Disclosed is an elongate peg, preferably of wood, which has lips or shoulders generally perpendicular to the length of the peg body and adjacent opposite ends. The lips or shoulders are on opposite sides of the peg body. The peg is used to tighten or tension the vertical lacing in "bongo" type drums by contacting adjacent pairs of vertical lacing with the peg whereby each lip is in contact with one of the adjacent pair of vertical lacing so that when the peg is flipped generally horizontal end forward, a twist is formed in the lacing pair at one end of the peg held by the lip while the other end of the peg is forcibly held against the drum shell by the force in the twist. In a preferred aspect, the drum profile is such that the spacing between the vertical lacing and the drum shell is increased slightly to facilitate more easily the flipping of the peg but still retain a peg end in forceable contact with the shell once flipped.

9 Claims, 3 Drawing Sheets

PEG DEVICE FOR USE IN TENSIONING DRUM SKINS AND TO NOVEL SHAPED DRUMS USING THE PEG DEVICE

FIELD OF THE INVENTION

The invention relates to the lacing and tensioning of skins on drums, particularly drums of the type descending from African drums.

BACKGROUND

Drums, colloquially known as "bongo" drums come in various styles. Two in particular which are common are descendants of African drums known as ASHIKOS and DJEMBES. The wooden shells of these drums are similar in shape and size, but not exactly the same as, other drums manufactured by many other companies.

Traditional ASHIKOS and DJEMBES drums function by sketching an animal hide or skin over one end of the wooden shell. In many cases (but not all) a system, which is adjustable, is used to create tension on the skin. The common tightening systems were the Traditional African Weave (T.A.W.) and a mechanical nut and bolt system.

The wooden shells of the ASHIKOS and DJEMBES based drums include at least a tapered lower portion or some section or area narrower than the top. The T.A.W. system utilizes three steel rings of two different diameters or sizes. Two of the rings, including the smaller diameter ring and one of the larger diameter rings, have a plurality of double-hitches or knots with interconnecting rope sections peripherally around the rings and are commonly known as "roped rings". The other larger diameter ring is known as an "unroped ring". The smaller sized roped ring slides over the narrower end of the drum shell and is sized relative to the shell so as to stop about half way up the height of the shell due to the shell's taper. The skin is wedged down between the top two rings with the roped ring on top. A single length of rope is then vertically laced between the ropes of the two roped rings to stretch and tension the skin over the top of the drum shell. Tensioning of the skin is conventionally done by weaving the excess rope from the vertical lacing through the vertical lacing in such fashion as to create a twist in the vertical lacing. The twist causes the vertical lacing to place the skin under more tension and effectively provide for the tuning of the drum.

The tensioning of the skin by this weaving technique is time consuming and requires skills which are difficult to teach. Accordingly, it would be advantageous to have some means to facilitate the tensioning of the skin which requires less time and less skill, and yet produces a fine product.

SUMMARY OF THE INVENTION

The invention related to a device which can be associated with the vertical lacing of the drum to effect tensioning in the skin. The preferred form of the device is a peg which is associated with adjacent strands of vertical lacing and flipped so that the lacing is twisted thereby shortening the lacing sufficient to create tension in the skin. The natural tendency of the twists to unravel or untwist causes a portion of the associated peg to be forced into contact with the shell wall which prevents it from further rotational movement.

It is preferred that there be some spacing between the vertical lacing and the wall of the drum shell to make it easier to flip the pegs. Accordingly, in a preferred embodiment, there is provided a shell with a peripheral recess which when the drum is skinned, the recess is juxtaposed to and associated with the vertical lacing to provide more space between the vertical lacing and shell to thereby facilitate easier flipping of the pegs.

The invention in one broad aspect provides an article for tensioning lacing on a drum comprising an elongate body having opposite ends, a lip or shoulder is inward of each end and is generally perpendicular to the body, the lip or shoulders are on laterally opposite sides of the body from each other.

The invention also comprehends a drum comprising a hollow annular shell, a skin and harness for securing and tensioning the skin to the shell. The harness includes an upper roped ring, an upper unroped ring and a lower roped ring, the lower roped ring having a diameter less than the two upper rings. The shell has a top end and bottom end and has an outer peripheral profile between the ends which will permit the lower roped ring to closely encircle the shell inward from the bottom end at a selected area on the shell, the shell profile such as to prevent the lower ring from going beyond the selected area. The skin is wedgedly held by the two upper rings with the roped upper ring above said unroped ring. The harness also includes vertical lacing between the upper roped ring and the lower roped ring which vertical lacing maintains the skin and two upper rings associated with the top end of the shell. Peg devices cooperate with adjacent pairs of the vertical lacing, the peg devices having longitudinally spaced ends with laterally opposite lips or shoulders for connection with the vertical lacing, whereby, when the peg device is generally perpendicularly associated with an adjacent pair of vertical lacing and flipped generally horizontal end-to-end, a twist is created in the vertical lacing adjacent the lip of one end of the peg devices which twist creates additional tension in the vertical lacing. The other end of the peg device is held against the shell by the force in the vertical lacing twist and prevented by the shell from flipping reversely.

Still further the invention provides a method of tensioning a skin on a drum having a shell with upper and lower ends, a skin and harness for securing the skin over the upper end of the shell, the harness including lacing means running generally vertical between an upper roped ring and a lower roped ring. The method comprises providing at least one peg device comprising an elongate body with a laterally opposed lip adjacent each end of the body for hooking connection with adjacent pairs of the vertical lacing means, placing each peg device generally horizontally in connection with an adjacent pair of the vertical lacing means so that each lip is in contact with a respective one of the lacing pair, flipping each peg device generally horizontally end for end whereby a twist is created on the lacing pair and one of said lips is closely associated with said twist in the vertical lacing pair and the end of the body adjacent the other lip is in contact with the shell under the force of the twist and prevented from reverse flipping by the shell.

Other aspects of the invention will become more event from the description of a preferred embodiment herein.

DESCRIPTION OF PRIOR ART DRUMS

Figure 1A:
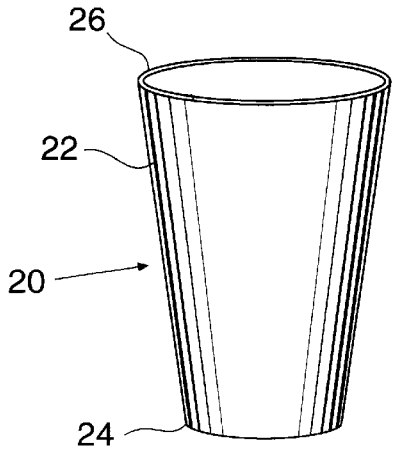
FIG. 1A PRIOR ART
FIGS. 1A and 1B are elevational views illustrating the basic shape of wooden shells of conventional (prior art) ASHIKO (FIG. 1A) and DJEMBE (FIG. 1B) drums.
Figure 1B:
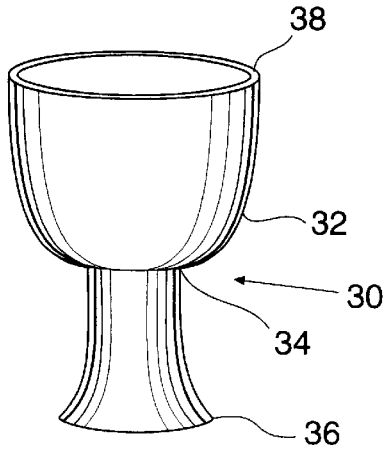
FIG. 1B PRIOR ART

Turning to FIGS. 1A and 1B, the basic shape of the shells of the ASHIKO drum 20 and DJEMBE drum 30 are shown. The hollow wooden shell 22 of the ASHIKO drum is generally frusto-conical in shape, tapering outwardly from the smaller bottom end 24 to the larger top or upper end 26. The hollow wooden shell 32 of the DJEMBE drum 30 is more "goblet-shaped" with a transition portion 34 between the smaller bottom end 36 and larger top or upper end 38.

The Traditional African Weave (T.A.W.) system will be explained briefly with respect to an ASHIKO shell.

Figure 2:
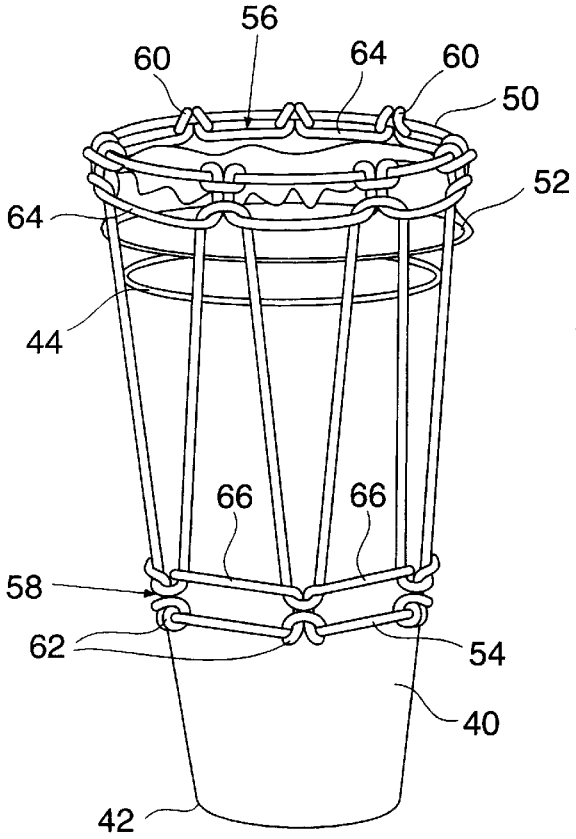
FIG. 2 PRIOR ART
FIG. 2 is an elevational view illustrating the formation of Traditional African Weave (T.A.W.) systems on an ASHIKO shell (prior art).
Figure 3:
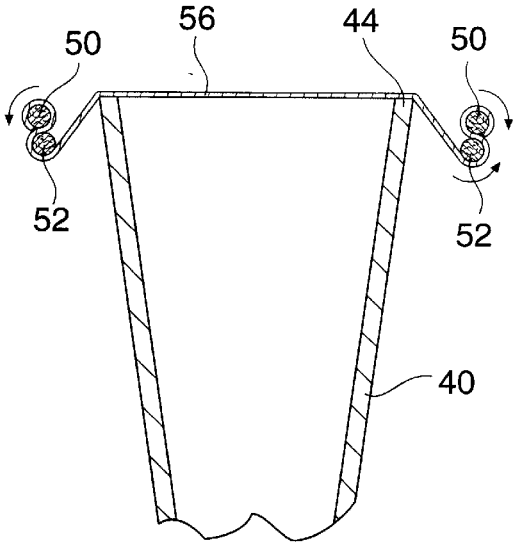
FIG. 3 PRIOR ART
FIG. 3 is a schematic, sectional view illustrating a skin and two upper rings associated with the upper part of the prior art drum of FIG. 2.

Turning to FIGS. 2 and 3, the hollow wooden shell 40 is tapered having a small bottom end 42 and larger upper or top end 44. The T.A.W. system provides a skinning harness including three steel rings, a top roped ring 50, a top unroped ring 52, and a bottom roped ring 54. Rings 50, 52, 54 are of about ¼" steel and each of the upper and lower roped rings 50, 54 has rope or lacing 56, 58 with double-hitches or knots 60, 62 circumferentially spaced around the respective ring. The double-hitches 60, 62 on each ring 50, 54 are formed from a single piece of rope or lacing 56, 58, with interconnecting portions 64, 66, all of which is well known in the art. The bottom roped ring 54 is smaller in diameter than the two top rings 50 and 52. When the lower or bottom roped ring 54 is pulled over the shell lower end 42, the diametric size of ring 54 prevents it from moving upwardly past about the middle of shell 40.

Figure 4:
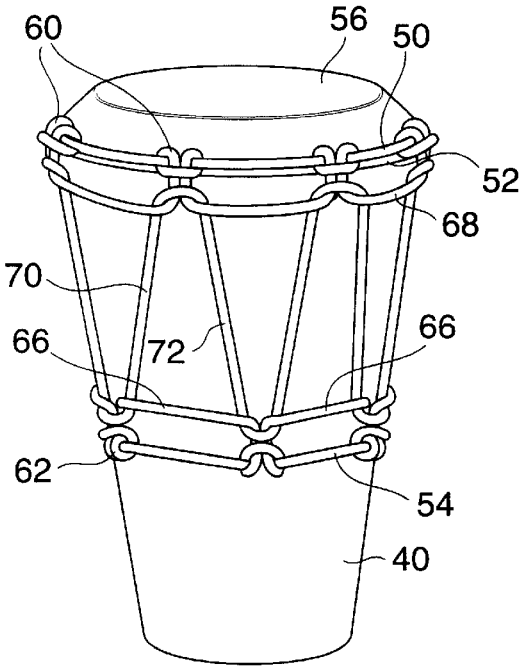
FIG. 4 PRIOR ART
FIG. 4 is an elevational view illustrating the prior art drum of FIG. 3 skinned but prior to tensioning.

The upper roped ring 50 and upper unroped ring 52 are the same diameter and are associated with and pulled down over the peripheral area of skin 56, as more particularly shown in FIG. 3, skin 56 being wedged between rings 50, 52. The diameter of rings 50, 52 and of skin 56 is such that rings 50, 52 are spaced from the periphery of shell 40 and spaced below the end 44 so as to be out of contact with the shell and to not interfere with the hands and fingers of the player of the finished drum. Once the skin is tensioned as set forth herein, excess skin is trimmed away from the area of rings 50, 52. The hitches 64 associated with the upper ring 50 have been omitted in FIG. 3 for the sake of clarity. Up/down or vertical roping or lacing 70, 72 extend between and interconnect with interconnecting rope portions 64 of the upper roped ring 50 and interconnecting portion 66 of the bottom roped ring 54 and when tensioned, tension skin 56 on and to shell top 44. With skin 56 wedged between upper rings 50, 52 as shown in FIG. 31 (excess skin not being shown) and with up/down or vertical lacing 70, 72 in place, the drum takes the form shown in FIG. 4, with the exception that excess lacing from the up/down or vertical lacing 70, 72 is not shown. FIG. 4 illustrates a drum that has been skinned and exhibits the similarities in all ASHIKO type and DJEMBE type drums which are skinned using the T.A.W. system. It will be appreciated that with a DJEMBE drum 30 using shell 32 and the T.A.W. system, bottom roped ring 54 would fit around transition area 34.

The key to a marketable drum is the sound created when further tension is created in the skin, giving the drum tune and volume.

Figure 5:
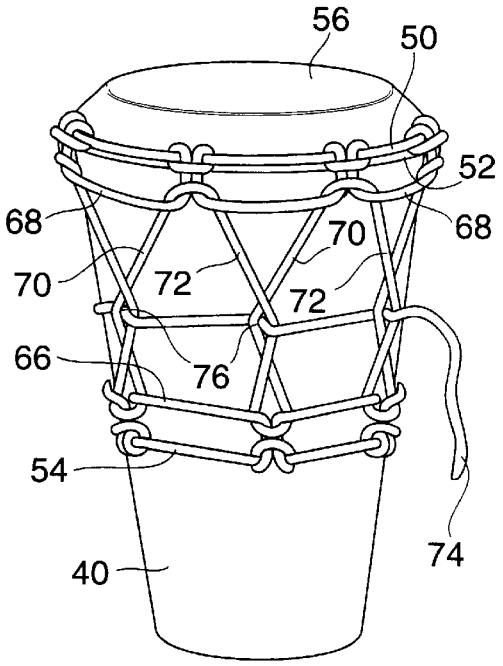
FIG. 5 PRIOR ART
FIG. 5 is an elevational view illustrating the final and conventional stage of tensioning the skin of the prior art drum shown in FIG. 4.

In the next stage of a T.A.W. system, excess lacing 74 from the up/down or vertical lacing 70, 72 is interwoven between adjacent up/down lacing 70, 72. More particularly, in the T.A.W. system, there is an excess 74 of rope left after up/down lacing 70, 72 has been completed, which excess 74 is then horizontally woven through the vertical or up/down lacing 70, 72, as shown in FIG. 5. The purpose of lacing 74 and its interweaving with up/down lacing 70, 72 is to create a twist in the vertical lacing at 76, resulting in more tension being applied to the skin.

The interweaving of excess rope 74 causing twists 76 in the up/down lacing 70, 72 usually starts just above the bottom roped ring 54 and works its way around the drum in a horizontal row until completion. To create further tension, another row (not shown) of weaved twists is added above the first one, and so on.

As noted previously, the T.A.W. system of horizontal roping the drum adds complications to the production of the drum and there is difficulty in teaching someone to do it properly. It also takes time, more time than considered desirable to tighten or tension the skin, using this method.

DESCRIPTION OF INVENTION

Figure 6:
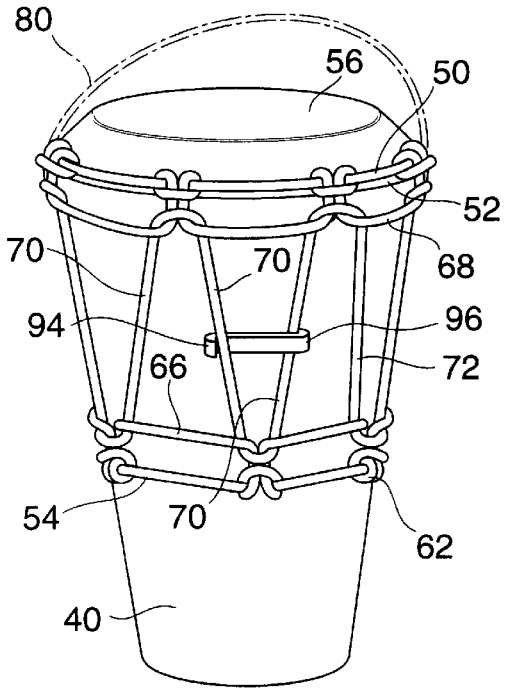
FIG. 6 is an elevational view of the peg of the invention associated to the vertical lacing of a prior art drum for purposes of tensioning the skin.
Figure 7:
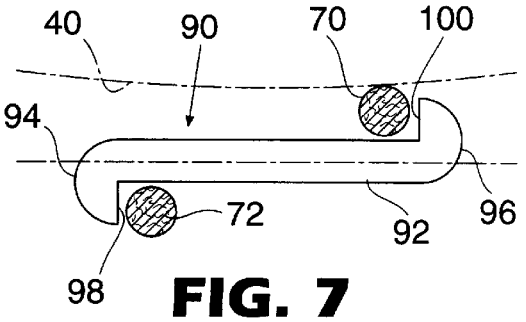
FIG. 7 is a sectional view along line 6—6 of FIG. 5 further illustrating the peg of the invention.
Figure 8:
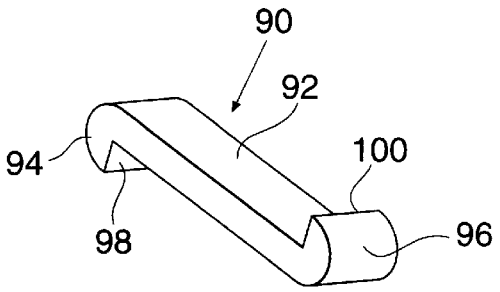
FIG. 8 is a perspective view of the peg of the invention as shown in FIGS. 6 and 7.
Figure 9:
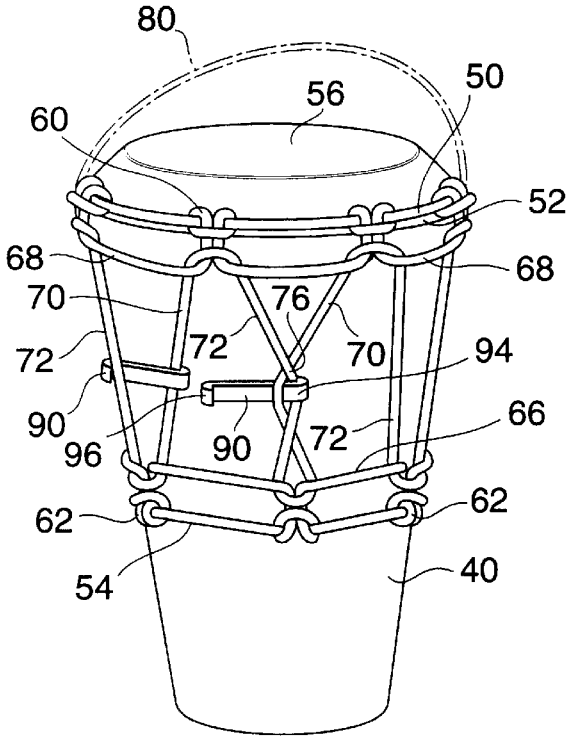
FIG. 9 is an elevational view illustrating the prior art drum of FIG. 4 but having the skin tensioned with pegs of the invention.

According to the invention, only enough excess rope 74 is provided to create a carrying handle a shown by dotted lines 80 in FIG. 6. A complicated weaving method is not required for tightening the skin. Instead, small pegs 90, one being shown in FIG. 6 and as further shown in FIGS. 7, 8 and 9, are associated with up/down or vertical lacing 70, 72 and flipped to create twists in the vertical lacing. Peg 90, as shown in FIGS. 7 and 8, is preferably of wood and has a generally rectangular body 92 with curved ends 94 and 96 defining opposed shoulder or lip elements 98, 100, lip elements 88, 90 being laterally opposite and mirror images of each other. Pegs 90, once inserted between adjacent up/down or vertical lacing 70, 72, are flipped end-to-end as shown in FIG. 9 with lacing pair 70/72 being twisted and held in the twist by end 94 which end 96 contacts and is prevented from reverse flipping by its contact with shell 40 under the force of the twist 76. The flipping of the pegs 90 provide the desired tension inducing twist 76 in the up/down lacing. If more tension is desired, more pegs can be used and flipped. In order to flip the pegs when in use with a prior art drum shell, the pegs may be angled slightly from the horizontal and then turned horizontally once flipped. Further, the lacing 70/72 may be pulled or forced outwardly during the flipping. The spacing created by the upper steel rings 50, 52 being spaced from the periphery of the shell wall as shown in FIG. 3 facilitates the pegs being flipped. Once flipped, the pegs are held in place by the tendency of the vertical lacing to unwind, thus causing one end of the peg, end 96 in the drawings, to be forced into contact with the wall of the shell 40.

A particularly preferred form of the drum shell and lacing would provide additional spacing between the shell and the vertical lacing to facilitate flipping of the pegs.

Figure 10:
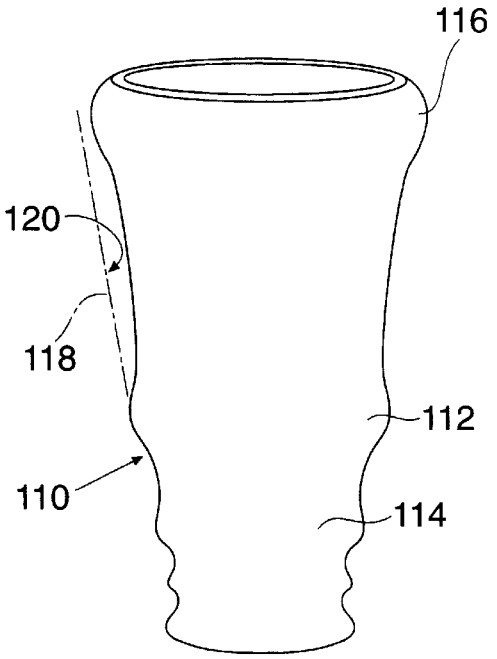
FIG. 10 is an elevational view illustrating a preferred form of a shell profile for use with the pegs of the invention.
Figure 11:
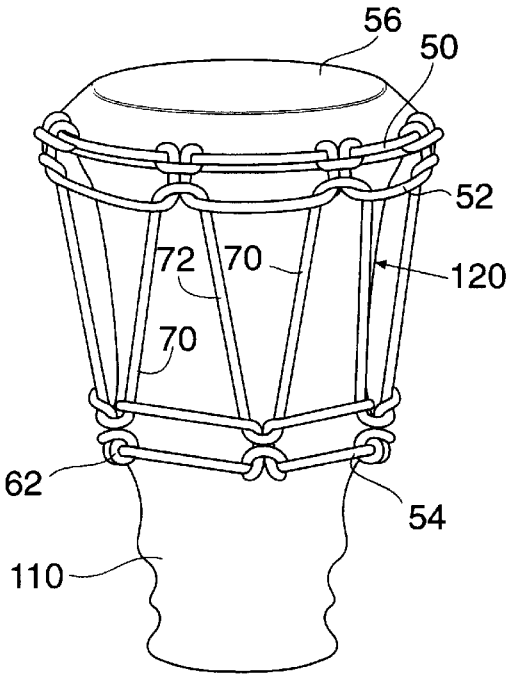
FIG. 11 is an elevational view illustrating the skinned shell of FIG. 10, prior to tensioning the skin.
Figure 12:
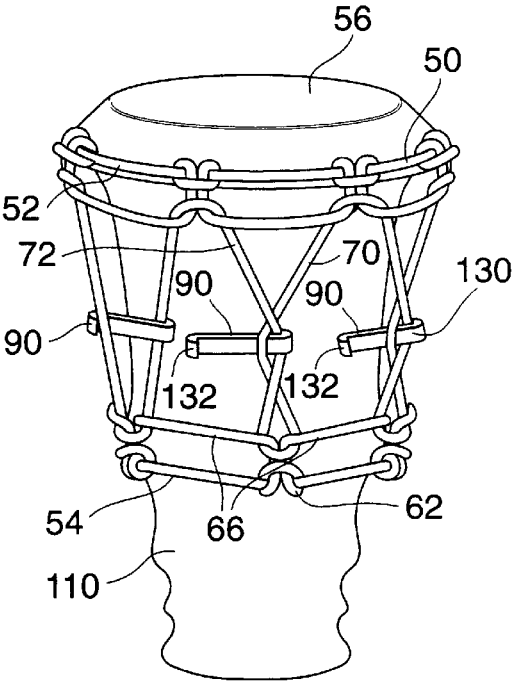
FIG. 12 is an elevational view similar to FIG. 11 illustrating one untwisted peg and two twisted pegs according to the invention.

Accordingly, in the most preferred embodiment of the invention, the shell 110 takes the form as shown in FIG. 10 wherein a subtle hump 112 is created in or on wall 114, just above where a lower roped ring would rest on the drum shell 110. A subtle hump 116 is also created at the top of the shell 110. These subtle humps on the wall of the shell cause the vertical lacing represented by dot-dash line 118 in FIG. 10 to be held slightly farther away from shell wall 110. Viewed in the alternative, shell 110 is constructed so as to have a generally vertical elongate recess or depression 120 in wall 114 between points 92, 94, which recess 120 provides additional spacing within which pegs 80 may be flipped more easily when the drum is skinned. This additional spacing may be seen in FIG. 11, although somewhat exaggerated in the drawing. The depth of spacing caused by the depression or recess 120 would be from ¼ to ½ inches, depending on the size of the drum. FIG. 12 illustrates the preferred drum shell of FIG. 10 skinned and shows two twisted pegs and one untwisted peg. Pegs 90 would be suitably located and associated with the vertical lacing around the drum. One end 130 of the peg secures the twist in the lacing 70, 72 whereas the other end 132 is held in contact with the shell by the force of the twist but the peg is prevented from untwisting, in line with the above description concerning FIG. 9.

The other humps 122 are for decorative purposes.

A preferred form of the peg 90, is about 68 mm long from end 94 to end 96 and generally rectangular in cross-section with a width of about 18.5 mm and a depth or height of about 13 mm. The depth of each shoulder or lip 98, 100 is about 5.5 mm and about 9 mm in from each end. The edges of peg 90 are rounded.

Although there has been set out preferred embodiments of the invention, various modifications thereto will be apparent to those skilled in the art and all those modifications which fall within the concept of the invention as claimed herein are contemplated.

The embodiments of the invention in which an exclusive property or privilege is claimed are defined as follows:

1. A device for tensioning lacing used for securing skins on an annular drum shell, said device comprising:

an elongate body having opposite ends;

a shoulder inward of each end, the shoulders being on laterally opposite sides of the body and generally perpendicular to said respective side, whereby, said device is adapted to cooperate with said adjacent laces with one lace associated with each shoulder, so that when said device is flipped end-for-end, a twist is created in said laces and said device is held by said twist and prevented from flipping reversely by said shell.

2. The article in claim 1, wherein the body is generally rectangular in cross-section with rounded corners and the body ends are rounded.

3. The article of claim 2, wherein the body is about 68 mm long, with each shoulder about 5.5 mm in depth and about 9 mm in from the respective end of the body.

4. A drum comprising a hollow annular shell, a skin and harness means for securing and tensioning said skin to said shell;

said harness means including an upper roped ring, an upper unroped ring and a lower roped ring, the lower roped ring having a diameter less than the two upper rings;

said shell having a top end and bottom end and having an outer peripheral profile between said ends which will permit said lower roped ring to closely encircle said shell inward from said bottom end at a selected area on said shell, said shell profile including means for preventing said lower ring from going beyond said selected area;

said skin being wedgedly held by said two upper rings with the upper roped ring above said unroped ring;

said harness means also including vertical lacing between said upper roped ring and said lower roped ring which vertical lacing maintains said skin and said two upper rings associated with the top end of said shell; and peg means for cooperation with adjacent pairs of said vertical lacing, said peg means having longitudinally spaced ends with laterally opposite lip means for connection with said vertical lacing, whereby, when said peg means is generally perpendicularly associated with an adjacent pair of said vertical lacing and flipped generally horizontally end-to-end, a twist is created in said vertical lacing adjacent the lip means of one end of said peg means which twist creates additional tension in said vertical lacing, the other end of said peg means being held against said shell by the force in the vertical lacing twist and prevented by the shell from flipping reversely.

5. The drum according to claim 4 wherein said drum peripheral profile is frusto-conical and said drum profile comprises a circumferential area with a diameter greater than the diameter of said lower roped ring defining said selected area.

6. The drum according to claim 4 wherein said drum peripheral profile is goblet-shaped with a lower stem portion and upper, bulbous portion and said goblet-shaped profile comprises a transition area between said stem portion and bulbous portion defining said selected area.

7. The drum according to claim 4 wherein said drum profile includes a circumferential hump portion intermediate the ends of said shell and a circular hump portion peripherally around the outer edge of said shell top end, said circumferential hump portion being of a diameter greater than the diameter of said lower roped ring and defining said selected area.

8. The drum according to claim 7 wherein said drum profile includes a depression area between said hump portions to more easily facilitate the flipping of said peg means without significantly affecting the prevention of reverse flipping of the peg means by said shell.

9. The method of tensioning a skin on a drum having a shell with upper and lower ends, a skin and harness means for securing said skin over the upper end of said shell, said harness means including lacing means running generally vertical between an upper roped ring and a lower roped ring, said method comprising:

providing at least one peg means comprising an elongate body with laterally opposed lip means adjacent each end of said body for hooking connection with adjacent pairs of said vertical lacing means;

placing each said peg means generally horizontally in connection with an adjacent pair of said vertical lacing means so that each said lip means is in contact with a respective one of said lacing pair;

flipping each said peg means generally horizontally end-for-end whereby a twist is created in said lacing pair and one of said lip means is closely associated with said twist in said vertical lacing pair and the end of the body associated with the other lip means is in contact with said shell under the force of the twist and prevented from reverse flipping by said shell.

* * * * *